US009297620B2

(12) United States Patent
Boretto et al.

(10) Patent No.: US 9,297,620 B2
(45) Date of Patent: Mar. 29, 2016

(54) ARROW HAVING MULTIPLE EXTERIOR DIAMETERS AND MULTIPLE INTERIOR DIAMETERS

(71) Applicant: Aldila Golf Corp., Poway, CA (US)

(72) Inventors: Tod Boretto, Poway, CA (US); Martin Connolly, Poway, CA (US)

(73) Assignee: Aldila Golf Corp., Poway, CA (US)

( * ) Notice: Subject to any disclaimer, the term of this patent is extended or adjusted under 35 U.S.C. 154(b) by 0 days.

(21) Appl. No.: 14/486,587

(22) Filed: Sep. 15, 2014

(65) Prior Publication Data

US 2015/0133245 A1 May 14, 2015

Related U.S. Application Data

(60) Continuation-in-part of application No. 13/909,888, filed on Jun. 4, 2013, now Pat. No. 8,834,658, which is a division of application No. 12/943,870, filed on Nov. 10, 2010, now Pat. No. 8,496,548.

(51) Int. Cl.
*F42B 6/04* (2006.01)
*F42B 33/00* (2006.01)
*F42B 12/36* (2006.01)

(52) U.S. Cl.
CPC ..... *F42B 6/04* (2013.01); *F42B 33/001* (2013.01); *F42B 12/362* (2013.01)

(58) Field of Classification Search
CPC ..... F42B 6/02–6/08; F42B 12/362
USPC ..... 473/578, 581–585
See application file for complete search history.

(56) References Cited

U.S. PATENT DOCUMENTS

| | | | | |
|---|---|---|---|---|
| 4,204,307 | A | 5/1980 | Pfetzing | |
| 4,645,211 | A | 2/1987 | Beiter | |
| 4,706,965 | A * | 11/1987 | Schaar | 473/578 |
| 5,154,432 | A | 10/1992 | Saunders | |
| 5,417,439 | A | 5/1995 | Bickel | |
| 6,017,284 | A * | 1/2000 | Giles | 473/578 |
| 6,251,036 | B1 | 6/2001 | Wu et al. | |
| 6,554,726 | B2 | 4/2003 | Thurber | |
| 6,821,219 | B2 * | 11/2004 | Thurber | 473/578 |
| 2006/0281593 | A1 | 12/2006 | Young | |
| 2009/0291785 | A1 * | 11/2009 | Smith | 473/578 |

OTHER PUBLICATIONS

Tim Dehn, "Gold Tip Arrow Production Bounces Back from Involuntary Plant Closure", Arrow Trade Magazine, United States.
Patrick Meitin, "Fat or Thin, Arrow Suppliers Have 3D Shooters Covered", Arrow Trade Magazine, Jan. 2007, United States.

* cited by examiner

*Primary Examiner* — Carson Gross
(74) *Attorney, Agent, or Firm* — Gary L. Eastman, Esq.

(57) ABSTRACT

A cylindrical carbon fiber arrow shaft formed with an exterior surface having single or multiple outside diameters and formed with an axial bore having multiple interior diameters. In a preferred embodiment, the exterior surface of the arrow shaft has an increased external diameter at the nock end and tapers to a smaller external diameter at the tip end. The axial bore has an internal diameter at the nock end corresponding to standard arrows having external diameters of 0.295 inches and tapers to a smaller internal diameter at the tip end. Modifying the length, diameter, and wall thickness of the arrow shaft varies the stiffness of the arrow shaft along the length and shifts the center of gravity along the length of the arrow shaft and as well. Utilizing standard internal diameters, nock and tips may be attached without spacers or inserts, thereby decreasing weight of the arrow significantly.

11 Claims, 9 Drawing Sheets

ARROW HAVING MULTIPLE EXTERIOR DIAMETERS AND MULTIPLE INTERIOR DIAMETERS

RELATED APPLICATION

The present application is a continuation-in-part of, and claims the benefit of priority to, Utility patent application Ser. No. 13/909,888 filed Jun. 4, 2013, which is now U.S. Pat. No. 8,834,658, which is a divisional of, and claims the benefit of priority to, U.S. patent application Ser. No. 12/943,870 filed Nov. 10, 2010, which is now U.S. Pat. No. 8,496,548 issued on Jul. 30, 2013.

FIELD OF THE INVENTION

The present invention relates generally to archery. The present invention is more particularly, though not exclusively, useful as an improved archery arrow having improved weight distribution and aerodynamics.

BACKGROUND OF THE INVENTION

Archery arrows have been in use for centuries. Over this time period, significant improvements have been made in the design of the arrows. For instance, the materials used for arrows have evolved from ancient arrows made of wood to modern arrows fabricated using lightweight high strength carbon fiber composites. Also, the fletching, or finning, has evolved from a standard X-shape feather to an aerodynamic three-tab design which minimizes contact with the bow and improves accuracy. Improvements have also been made to the arrow head to improve the aerodynamics and to the nock to decrease weight.

With the advancements in technology, the performance of an arrow can be tuned to fit an archer's preferences. Altering the physical properties of an arrow alters the flight characteristics. Traditionally, archers chose an arrow shaft with a defined static spine, which is the stiffness of the arrow and its resistance to bending. Based on their chosen arrow shaft and corresponding static spine, they then add tips, fletching, and knocks to tune the dynamic spine, which is the deflection of the arrow when fired from a bow. Thus, the physical properties of the arrow shaft, including the overall weight and the center of gravity of the arrow, affects the arrow performance.

A recent trend in the arrow industry is to provide an arrow having a wider diameter shaft. Typical arrows have had a standard external shaft diameter of 0.295 inches which has provided for a reasonably rigid arrow made from today's materials. However, a thicker arrow having an external shaft diameter of 0.380 has been developed for certain archery applications.

However, with the wider diameter of these thicker arrows comes an increase in weight and aerodynamic drag caused by the larger cross-section. In order to minimize the effects of the larger diameter on the arrow performance, the industry has taken steps to minimize weight of the arrow. For instance, some manufacturers have provided adaptors which allow the archer to use standard diameter nocks. However, in order to use the smaller diameter nocks, a transitional sleeve, or taper, must be inserted between the shaft and the nock. Unfortunately, this added insert provides excess weight at the fletching end of the arrow. This is particularly so when using carbon-fiber arrows where the weight of the arrow is small compared to the weight of the tip and nock.

In light of the above, it would be advantageous to provide an arrow having increased strength and decreased drag which is also lightweight. It would also be advantageous to provide an arrow capable of using standard nocks without having to add weight-increasing adapters and inserts. It would further be advantageous to provide an arrow having multiple interior diameters, multiple exterior diameters, and multiple wall thicknesses to alter the weight distribution of an arrow shaft and control the center of gravity. It would further be advantageous to provide an arrow having multiple interior diameters, multiple exterior diameters, and multiple wall thicknesses to vary the static spine of the arrow shaft. It would further be advantageous to provide an arrow having a larger knock end to better absorb the forces of a bow string when fired. It would further be advantageous to provide an arrow having a smaller forward section for better aerodynamics and deeper penetration.

SUMMARY OF THE INVENTION

The present invention includes a cylindrical carbon fiber arrow shaft formed with an increased external diameter of 0.380 inches. This arrow shaft is formed with an axial bore which has a first internal diameter throughout a substantial portion of the shaft length, and a second, smaller, internal diameter throughout the fletching end of the arrow. The second internal diameter corresponds to the internal diameter of standard arrows having external diameters of 0.295 inches. Using this standard internal diameter at the fletching-end of the arrow, standard nocks may be used without the need for any spacer or insert, thereby decreasing fletching-end weight significantly and providing for the proper and more desired location of the center of gravity forward on the arrow.

The dual interior-diameter design of the arrow of the present invention is accomplished using a cylindrical mandrel having two external diameters. The first mandrel diameter corresponds to the portion of the arrow shaft having the external diameter of 0.380 inches, and the second mandrel diameter corresponds to the standard nock dimensions.

The carbon fiber shaft is formed on the mandrel. With the aid of releasing agents, the mandrel is removed leaving a tubular shaft having a decreased internal diameter at the fletching end of the arrow. A taper is formed at the end of the arrow to provide for a smooth transition between the arrow shaft and the smaller-diameter nock. A nock is then inserted, the fletching is applied, and a tip is installed to provide a high strength, low eight archery arrow having less mass than comparable arrows.

In an alternative embodiment, the present invention includes a cylindrical carbon fiber arrow shaft formed with a uniform exterior surface having a single exterior diameter and a non-uniform axial bore having multiple interior diameters. In a particular embodiment, the non-uniform axial bore has a first internal diameter throughout the forward section of the shaft and a second internal diameter throughout the remaining tail section of the shaft length. Alternatively, the non-uniform axial bore is formed with a combination of cylindrical and tapered sections, with each section having a different diameter.

In an alternative embodiment, the present invention includes a cylindrical carbon fiber arrow shaft formed with a non-uniform exterior surface having multiple diameters and a non-uniform axial bore having multiple diameters. In a particular embodiment, the cylindrical carbon fiber arrow shaft tapers from a tail section to a forward section, wherein the tail section has a larger diameter than the forward section. By having a larger exterior diameter at the tail end, the tail end of the arrow shaft is better able to absorb and dampen the impact from the bow string when the arrow is fired. The smaller diameter forward section provides less aerodynamic drag and better penetration as compared to an arrow shaft with a forward section having a larger diameter.

The arrow shaft is formed with a non-uniform axial bore having multiple diameters. The axial bore may have stepping internal diameters, such that a first diameter terminates into a smaller second diameter. Alternatively, the axial bore may have a tapering section between each major diameter such that a first diameter tapers into a second diameter.

The nonuniform axial bores of the alternative embodiments allow the precise control of the center of gravity of the arrow shaft. By modifying each section of the axial bore, particularly the diameters and the length of each portion, the location of the center of gravity may be shifted along the length of the arrow shaft. The use of multiple internal diameters also affects the stiffness of the arrow. By having an internal axial bore with different internal diameters, the stiffness of the arrow along the shaft length is non-uniform thereby affecting the static and dynamic spine of the arrow. The option to vary the interior and exterior diameters allows a user more options to properly tune the arrow to their specifications.

The carbon fiber arrow shafts are formed on a mandrel having multiple diameters. In certain embodiments, the mandrel may be made of multiple pieces mated together to form a single piece. By utilizing a two piece mandrel, an arrow shaft having an axial bore with a smaller internal diameter preceded by a larger diameter and followed by a larger diameter is possible. With the aid of releasing agents, the mandrel is removed leaving a tubular shaft having a non-uniform internal axial bore having multiple diameters. A nock is then inserted, the fletching is applied, and a tip is installed to provide a high strength, low weight archery arrow having less mass than comparable arrows.

DESCRIPTION OF THE DRAWING

The objects, features, and advantages of the method according to the invention will be more clearly perceived from the following detailed description, when read in conjunction with the accompanying drawing, in which.

DETAILED DESCRIPTION

Figure 1:
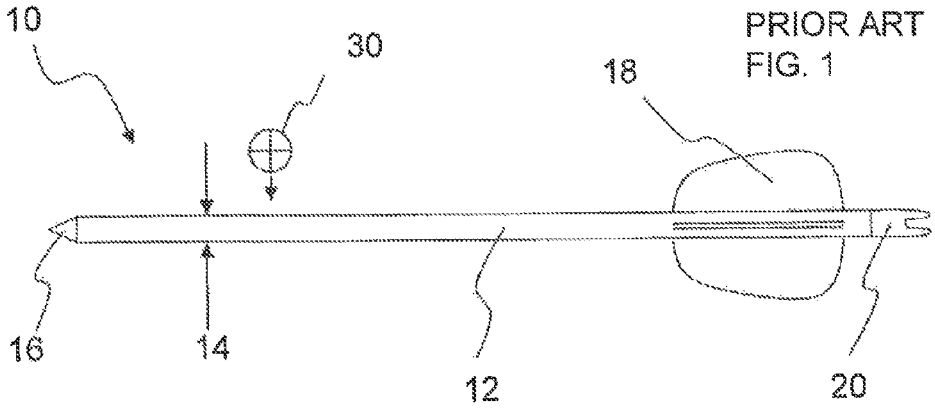
PRIOR ART FIG. 1
FIG. 1 is a side view of a PRIOR ART arrow showing the small exterior diameter and placement of the tip, fletching and nock, and an exemplary center-of-gravity.

Referring now to FIG. 1, a side view of a PRIOR ART arrow 10 is shown detailing the small exterior diameter 14 and placement of the tip 16, fletching 18 and nock 20. As is known in the industry, the length of the arrow, the weight of the tip and fletching determines in large part the location of the center-of-gravity 30 of the arrow. It is also known in the industry that the placement of the center of gravity in positions along the length of an arrow can significantly affect the flight of the arrow.

The nock can also affect the position of the center of gravity. For instance, in arrows having very low weights, the addition of the nock at the end of the arrow can bring the center of gravity away from the tip, sometimes resulting in a less-than-optimum placement.

Figure 2:
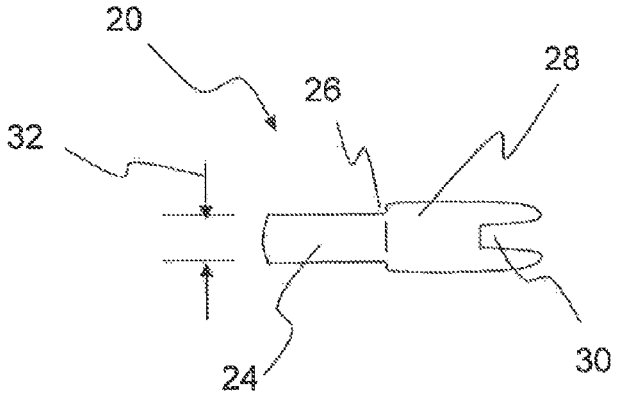
PRIOR ART FIG. 2
FIG. 2 is a detailed view of a standard nock as used in conjunction with small exterior diameter arrows and showing the insert and bow receiver.

FIG. 2 is a detailed view of a standard nock 20 as used in conjunction with small exterior diameter arrows 10. Nock 20 includes an insert 24 leading through a stop 26 to a body 28 formed with a bow receiver 30. The diameter 32 of the insert 24 is such that the insert is closely and securely received in the bore of an arrow shaft. Additionally, an adhesive may be applied when inserting the insert into the shaft to provide added strength for the retention of the nock.

Figure 3:
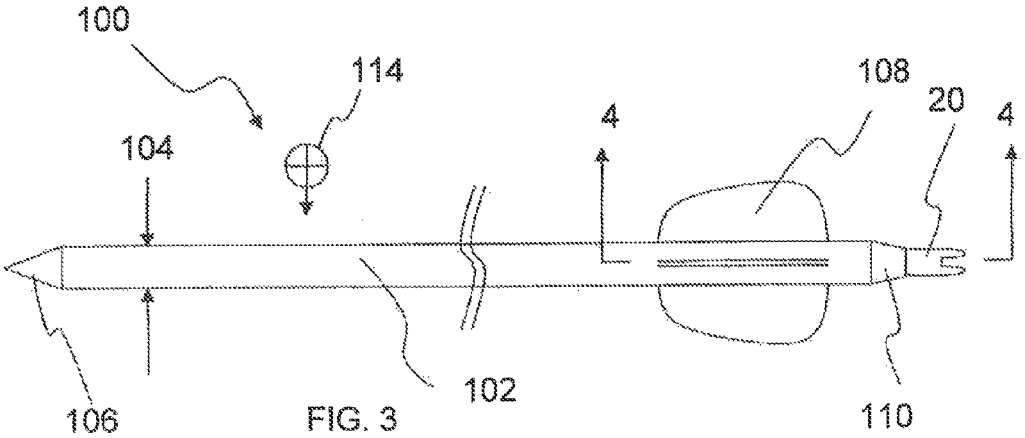
FIG. 3 is a side view of an arrow of the present invention having a wider exterior diameter and having a tip, fletching, nock, and formed with a tapered portion of the carbon fiber body into which the nock is inserted, as well as an exemplary center-of-gravity.

Referring now to FIG. 3, a side view of arrow 100 of the present invention has a shaft 102 having a wider exterior diameter 104. In a preferred embodiment, the exterior diameter is 0.380 inches, however, it is to be appreciated that other diameters could be contemplated without departing from the present invention.

Arrow 100 includes a tip 106 which is typically a weighty metallic material, such as steel, and can be formed with different shapes for specific uses, such as target shooting, hunting, etc. Retching 108 is attached to the exterior of body 102 as is known in the art, and nock 20 is inserted into the fletching end of the shaft body 102.

Arrow shaft 102 is formed with an axial bore (shown in FIG. 4) and formed with tapered portion 110 which has an interior diameter which corresponds to the interior diameter of standard 0.295 inch arrows. Using this standard internal diameter at the fletching-end of the arrow, standard nocks may be used without the need for any spacer or insert, thereby decreasing fletching-end weight significantly and providing for the proper and more desired location of the center of gravity forward on the arrow.

Arrow 100 is shown having an exemplary center-of-gravity 114 which as is known in the art, may be adjusted along the length of the shaft 102 by adjusting the weights of the tip 106, fletching 108 and nock 20. Also, the position of the center of gravity may be affected by the shortening, or cutting, of the length of the arrow.

Figure 4:
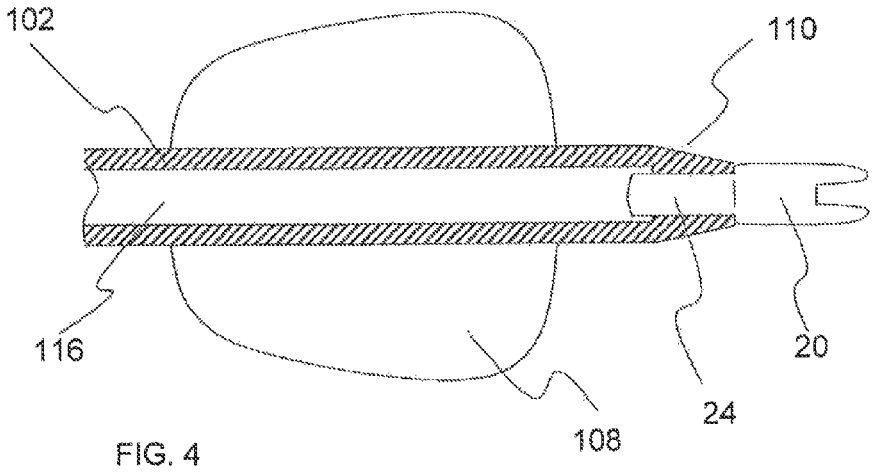
FIG. 4 is a cross-sectional view of the fletching end of the arrow of the present invention showing the portion of the arrow having a smaller internal diameter sized to closely receive a standard nock.

FIG. 4 is a cross-sectional view of the arrow 100 of the present invention taken along line 4-4 of FIG. 3, and showing the portion of the arrow 100 having a smaller internal diameter sized to closely receive a standard nock 20. Specifically, shaft 102 is formed with a bore 116 having a transition at the nock-end of the arrow to a smaller diameter bore sized to receive the insert 24 of nock 20.

A tapered section 110 of body 102 transitions the arrow from the larger diameter of 0.380 inches, to a smaller diameter, such as 0.295 inches to correspond to the diameter of the nock 20. The length of the taper and the angle of the taper can vary depending on the manufacturing of the arrow 100 without departing from the spirit of the present invention.

Figure 5:
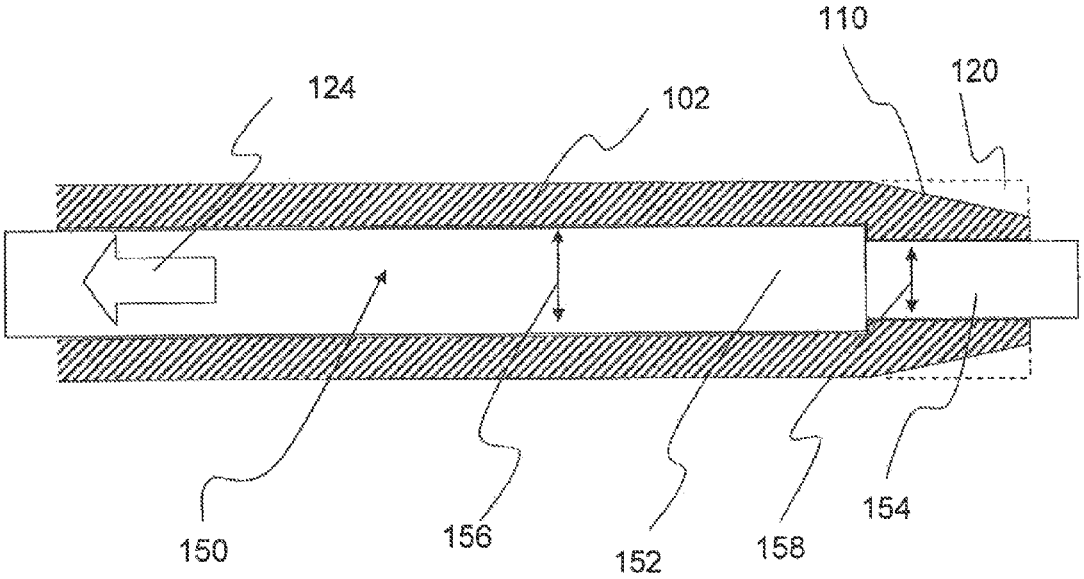
FIG. 5 is a cross-sectional view of the arrow of the present invention showing the placement of a mandrel having two diameters positioned to form an arrow body having a first diameter, and a fletching portion having a smaller diameter, and also showing the formation of the taper by removing a portion of the carbon fiber materials, such as by grinding.

An example of a typical manufacturing method is depicted in FIG. 5. Carbon fiber manufacturing is known in the art, and includes the wrapping of carbon fibers around a mandrel which is then heated and formed into the desired article of manufacture. For the present invention, a cross-sectional view of the arrow 100 of the present invention shows the use of a mandrel 150 having two sections 152 and 154. Section 152 has a diameter 156, and section 154 has a diameter 158. These diameters 156 and 158 cooperate to form an arrow body 102 having a first larger diameter 156, and a fletching portion having a smaller diameter 158 which corresponds to the standard nock dimensions.

Tapered section 110 is formed on the fletching end of body 102 by removing a portion 120 of the carbon fiber materials as shown by dashed lines. The removal of the material of body 102 may be accomplished using a variety of techniques, such as by grinding as is known in the art.

Figure 6:
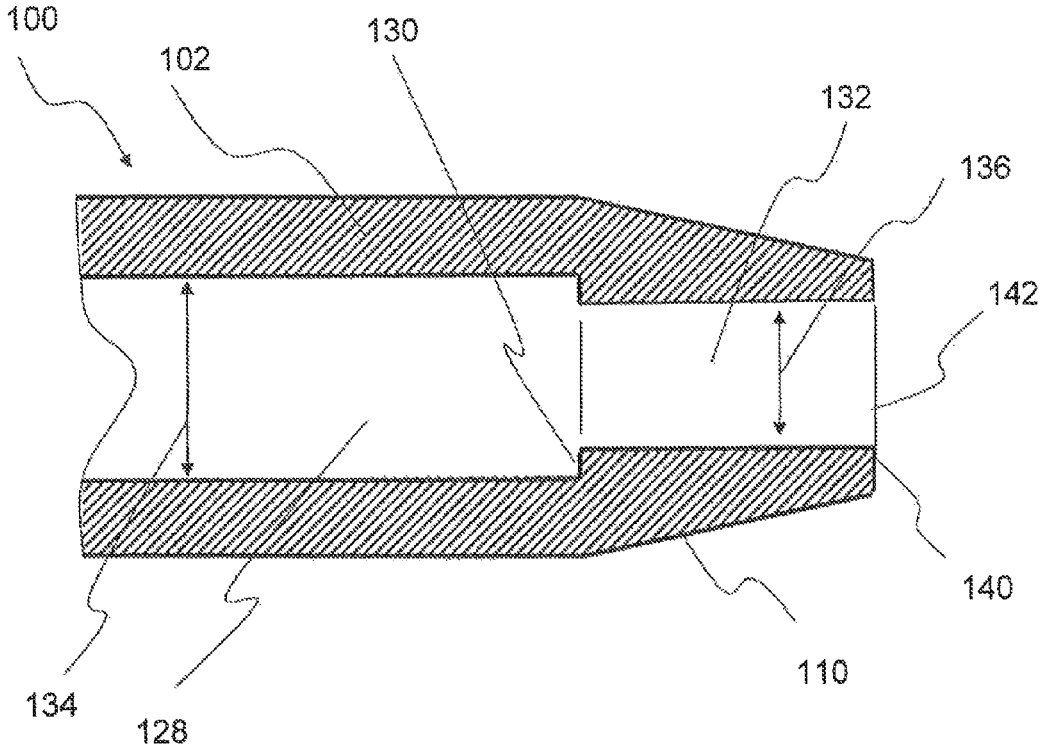
FIG. 6 is a cross-section of the fletching end of an arrow showing the first internal body diameter and the second smaller internal body diameter, and the transition stop, as well as the nock receptor formed to receive a standard nock.

FIG. 6 is a cross-section of the fletching end of arrow 100 showing the first internal body diameter 134 and the second smaller internal body diameter 136. Body 102 is formed with a transition stop 130 between diameters 134 and 136. By decreasing the diameter 136 of body 102, there is sufficient strength in the materials of the shaft so that nock 20 (not shown this Figure) is securely received in the shaft. Moreover, by forming the diameter 136 of inlet 132 to receive a standard lightweight nock, the weight of the arrow assembly is decreased, as ell as making a more cost-effective arrow.

The arrow of the present invention exhibits improved aerodynamics, lower mass, and has a better weight distribution than other large diameter arrows which require the use of heavy transition pieces, or super-sized mocks. The use of the standard nock without any additional hardware provides the arrow of the present invention with a significant advantage over other arrows.

Figure 7:
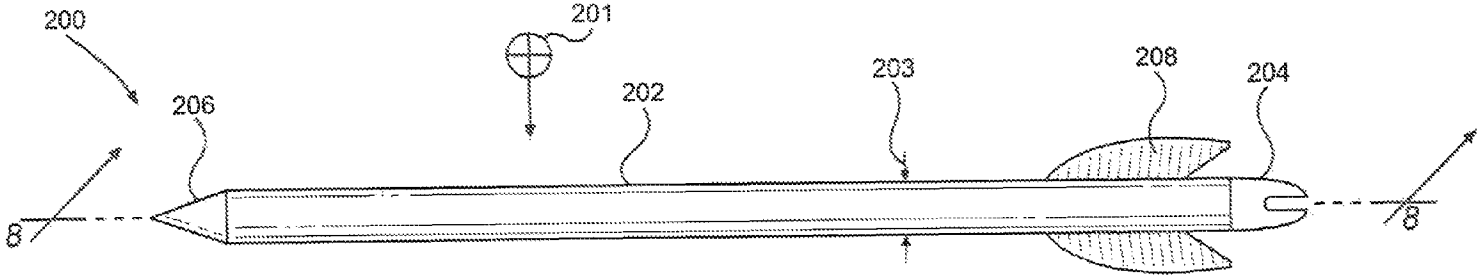
FIG. 7 is a side view of an alternative embodiment of an arrow of the present invention having a uniform exterior diameter and having a tip, fletching, nock, and an exemplary center-of-gravity.

Referring now to FIG. 7, a side view of an alternative embodiment of an arrow of the present invention generally designated 200 is shown. Arrow 200 includes arrow shaft 202, a tip 206 inserted into one end of arrow shaft 202, a nock 204 inserted into the second end of arrow shaft 202, and fletching 208 attached to the exterior of arrow shaft 202 adjacent to the nock 204. Arrow shaft 202 is formed with a uniform exterior surface having an exterior diameter 203. Arrow 200 is shown having an exemplary center of gravity 201 which, as is known in the art, may be adjusted along the length of the arrow shaft 202 by adjusting the weight, among other properties, of the tip 206, fletching 208 and nock 204 while taking into account the center of gravity of the arrow shaft 202.

Figure 8:
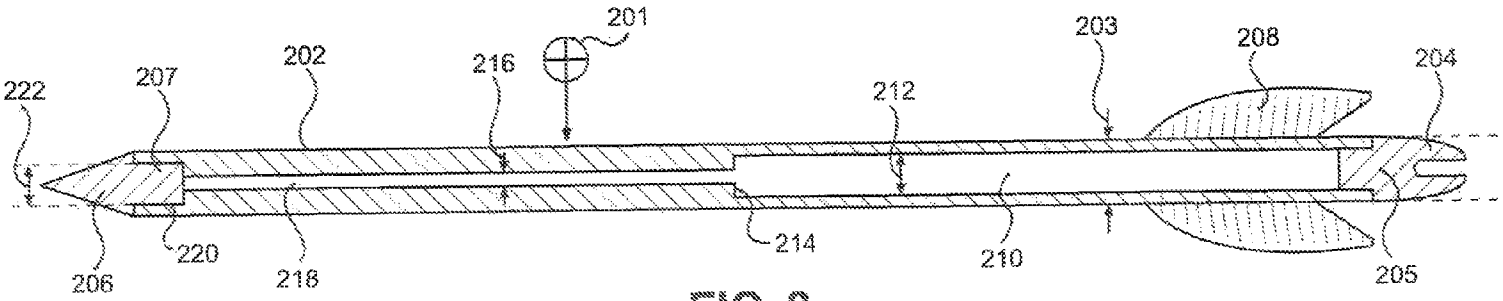
FIG. 8 is a cross-section view of the arrow of FIG. 7 taken along line 8-8 showing the arrow shaft formed with a uniform exterior diameter and a non-uniform axial bore having multiple diameters.

FIG. 8 is a cross-sectional view of arrow 200 taken along line 8-8 showing the arrow shaft 202 with an axial bore having multiple interior diameters. The axial bore of arrow 200 has a tail bore 210 with a diameter 212 terminating at a shoulder 214, and a forward bore 218 having a diameter 216 begins at shoulder 214 and terminates at a tip bore 220 having a diameter 222 which may be, in an alternative embodiment, equal to diameter 203 of the tail bore 210. Diameter 216 of the forward bore 218 is smaller than diameter 212 of the tail bore 210 and diameter 222 of forward bore 220. The size of the bores is not meant to be limiting and it is contemplated that other variations in bore diameters may be used without departing from the spirit and scope of the invention.

The tail bore 210 is sized to closely receive an insert 205 of nock 204 and the tip bore 220 is sized to closely receive an insert 207 of tip 206. The outside diameter of insert 205 of nock 204 creates an interference fit with the tail bore 210 to provide a secure fit for nock 204 and may be affixed with an adhesive or other attachment means known in the art such as a twist lock or threads. Tip 206 may be attached to the arrow shaft 202 in substantially similar manner as insert 205. The exterior diameter of the arrow shaft 202 does not require a tapered exterior section as the exterior diameter of the arrow shaft 202 matches the exterior diameter of tip 206 and nock 204.

In an exemplary example, the external diameter 203 of arrow 200 is approximately between 0.210 and 0.245. Due to the small external diameter 203, the forward bore 218 diameter 216 may be too small to accommodate a tip or tip insert currently available in the marketplace. To use the tips or tip inserts currently available in the marketplace, the tip bore 220 may be sized larger than forward bore 218, allowing the use the appropriate tip 206. As a result of using a smaller external diameter as compared to arrows with standard external diameters of 0.295 inch, arrow 200 is lighter and the use of smaller available tips and nocks without the need for any spacer or insert further decreases overall weight significantly. This provides for the proper and more desired location of the center of gravity forward on the arrow 200. It is also contemplated that tips and tip inserts made specifically to fit the forward bore 218 diameter 216 may be used, thereby removing the need of the tip bore 220.

As depicted, the arrow 200 has tail bore 210, forward bore 218 and tip bore 220. The arrow shaft 202 has multiple wall thicknesses as a result of the tail bore 210, forward bore 218 and tip bore 220. Due to the varying thicknesses of the arrow shaft 202 walls, the weight distribution of the arrow shaft is unequal. The smaller forward bore 218 compared with the tail bore 210 places more material and thus weight towards the front of the arrow shaft 202. Typically, an arrow shaft having a uniform interior and exterior diameter constructed of a uniform material the center of gravity of the arrow shaft is located at the midpoint of the arrow shaft. However, with the multiple interior diameters of arrow shaft 202 the center of gravity 201 may be located off-center towards the tip 206. By modifying the length and diameter of the tail bore 210, forward bore 218 and tip bore 220 the center of gravity 201 may be shifted along the length of the arrow shaft 202. It is appreciated that the number of bores with different diameters could be varied as well without departing from the spirit and scope of the present invention. After taking into account the center of gravity of the arrow shaft 202, the tip 206, fletching 208, and knock 204 is applied to adjust the center of gravity 201 of the arrow 200. As a result, a greater degree of adjustability and tuning of the center of gravity 204 of the arrow 200 may be achieved.

The construction of the arrow 200 having multiple interior diameters and multiple exterior diameters also affect the stiffness of the arrow 200. The stiffness of an arrow is determined by the material of the arrow, the interior and exterior diameters of the shaft, the thickness of the shaft wall, the interior and exterior wall geometry, and the length of the arrow shaft. Although the arrow shaft 202 has an overall stiffness, the stiffness of the arrow shaft 202 varies along the length due to the multiple diameters and wall thicknesses.

Figure 9:
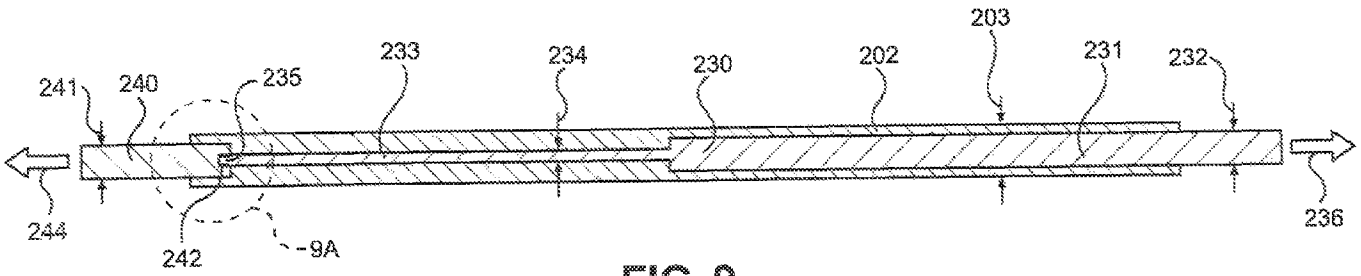
FIG. 9 is a cross-section view of the arrow of FIG. 7 showing the placement of a multi-piece mandrel having three (3) diameters positioned to form an arrow shaft having multiple internal diameters.
Figure 9A:
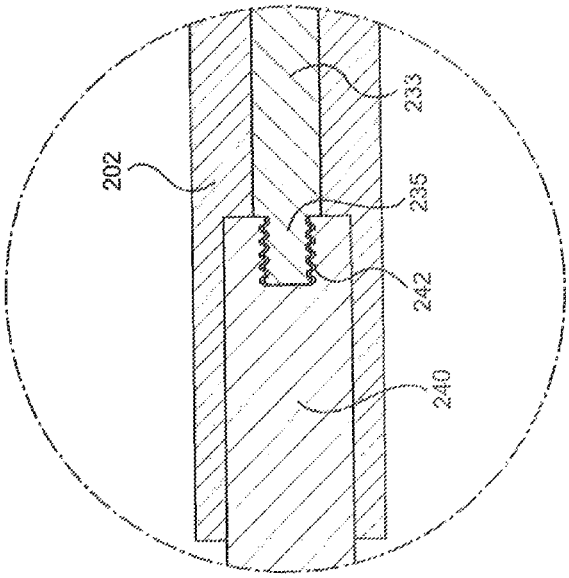
FIG. 9A is a partial view of the cross-section view of the arrow of FIG. 7 invention shown in FIG. 9.

An example of a typical manufacturing method for arrow 200 is depicted in FIG. 9 in conjunction with FIG. 9A. Carbon fiber manufacturing is known in the art, and includes the wrapping of carbon fibers around a mandrel which is then heated and formed into the desired article of manufacture. For the present invention, a cross-sectional view of the arrow 200 shows the use of a multi-piece mandrel having a primary mandrel 230 and a secondary mandrel 240. The primary mandrel 230 is formed with a first cylindrical section 231 having a first diameter 232 forming a cylindrical section extending a predetermined distance and terminating into a second cylindrical section 233 having a second diameter 234. At one end of the primary mandrel 230 having second diameter 234 a threaded stud 235 is integrally formed. Secondary mandrel 240 is formed with a first diameter 241 and a threaded bore 242 corresponding to the threads of threaded stud 235 of the primary mandrel 230.

The primary mandrel 230 is threadably received by the secondary mandrel 240, forming the mandrel in which the carbon fiber is wrapped to from arrow shaft 202. The use of the threaded stud 235 and bore 242 is not meant to be limiting and alternative means of fastening the primary mandrel 230 to the secondary mandrel 240 are contemplated without departing from the scope and spirit of the invention. Further, it is contemplated that arrow 200 may be formed without tip bore 220, thereby removing the need for secondary mandrel 240 or may be formed with additional bores requiring addition mandrel pieces.

After the carbon fiber has hardened and cured into arrow shaft 202, with the aid of releasing agents the primary mandrel 230 and secondary mandrel 240 are removed from the arrow shaft 202. Before removing the primary mandrel 230 and secondary mandrel 240, the mandrels are decoupled from one another. This allows the primary mandrel 230 to be removed in direction 236 and secondary mandrel 240 removed from the arrow shaft 202 in direction 244, opposite of direction 236. The two piece mandrel enables the creation of an arrow shaft having multiple internal diameters in which a single mandrel would not be able to. By utilizing a two piece mandrel, an arrow shaft having an axial bore with a smaller internal diameter preceded by a larger diameter and followed by a larger diameter similar to arrow shaft 202 is possible.

As a single piece mandrel, the removal of a mandrel from an arrow shaft would not be possible as the larger diameter portion of the mandrel would not be able to pass through the smaller diameter portion of the arrow shaft. However, by creating the mandrel in multiple pieces, the mandrel can be decoupled and pulled in opposite directions 236 and 234 to remove the mandrel from the arrow shaft. It is contemplated that the mandrel may be sized differently and be composed of multiple pieces to create various axial bores for arrow shafts without departing from the spirit and scope of the invention.

Figure 10:
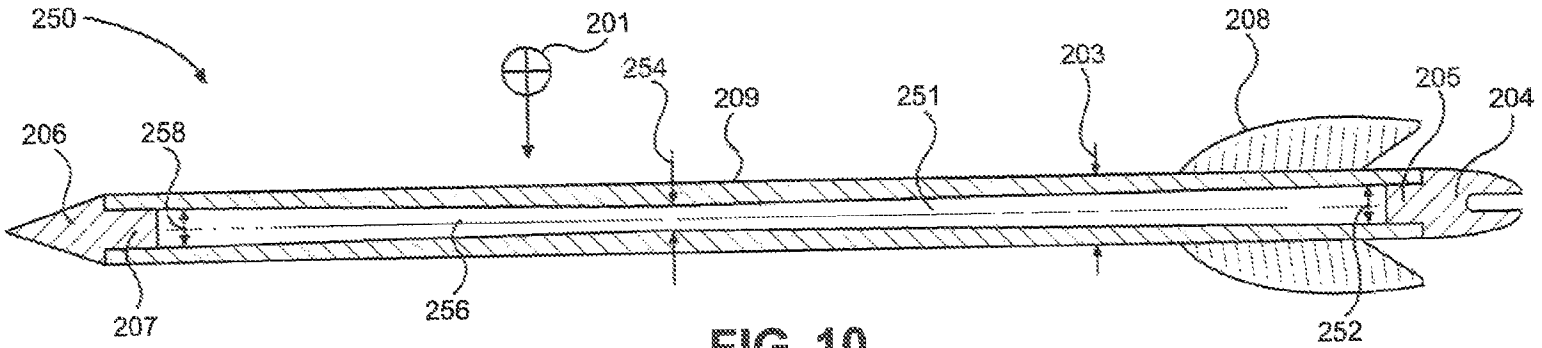
FIG. 10 is a cross-sectional view of the arrow of the present invention, formed with a uniform exterior diameter and an alternative non-uniform axial bore having cylindrical and tapered sections with multiple diameters.

Referring now to FIG. 10, a cross-sectional view of the arrow 250 of the present invention taken along lines 8-8 of FIG. 7 is shown with an alternative non-uniform axial bore. Arrow 250 is formed with alternative non-uniform axial bore having a tail bore 251 and a forward bore 256. The tail bore 251 has a nock diameter 252 extending a predetermined distance to accommodate insert 205 of nock 204 which then tapers to a mid-section diameter 254 sized smaller than nock diameter 252. The forward bore 256 has a tip diameter 258 extending a predetermined distance to accommodate insert 207 of tip 206 which then tapers to the midsection diameter 254. As a result of the tail bore 251 and the forward bore 256, arrow shaft 202 has multiple internal diameters and varying wall thicknesses. It is contemplated that various combinations of cylindrical bores and tapered bores may be used to form the internal bore of the arrow shaft 202 to create multiple internal diameters without departing from the scope and spirit of the invention.

Before applying the tip 206, fletching 208, and nock 204 to adjust the center of gravity 201 of the arrow 250 the center of gravity of the arrow shaft 202 needs to be accounted for. The length, diameter, and wall thickness of the arrow shaft 202 may be modified to adjust the center of gravity of the arrow shaft 202 along the length by adjusting the internal bores of the arrow shaft. As a result, a greater degree of adjustability and tuning of the center of gravity 201 of the arrow 200 may be achieved. Additionally, although there is an overall stiffness to the arrow shaft 202, the stiffness of varies along the length of the arrow shaft 202 due to the construction of the arrow shaft 202 having multiple diameters and wall thicknesses.

Figure 11:
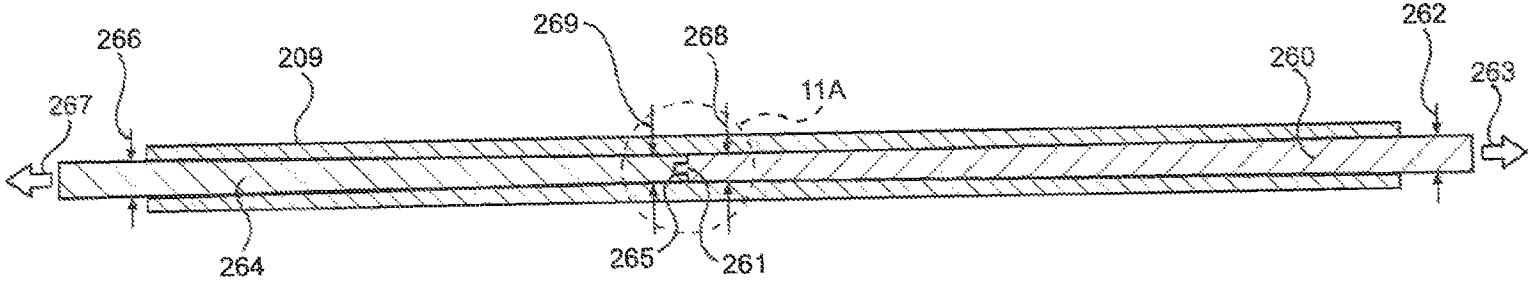
FIG. 11 is a cross-sectional view of the arrow of the present invention of FIG. 10 showing the placement of a multi-piece mandrel having three (3) cylindrical sections and two tapering sections positioned to form an arrow shaft having multiple internal diameters.
Figure 11A:
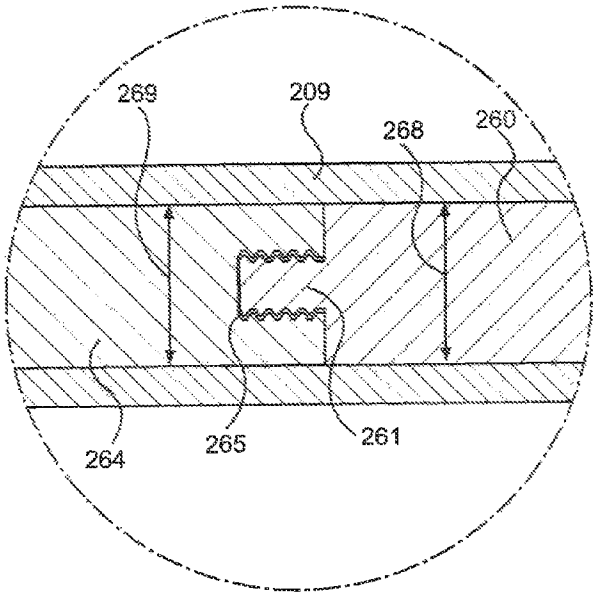
FIG. 11A is a partial view of the cross-sectional view of the present invention shown in FIG. 11.

Now referring to FIG. 11 in conjunction with FIG. 11A, a manufacturing method for arrow 250 having non-uniform axial bore with a tail bore 251 and forward bore 256 is depicted. Carbon fiber manufacturing is known in the art, and includes the wrapping of carbon fibers around a mandrel which is then heated and formed into the desired article of manufacture. For the present invention, a cross-sectional view of the arrow 250 of the present embodiment shows the use of a mandrel having a tail end mandrel 260 and a forward end mandrel 264 mechanically coupled together. Tail end mandrel 260 has a cylindrical shape with a first diameter 262 extending for a predetermined distance and then tapering into a smaller second diameter 268. Tail end mandrel 260 is further formed with a threaded stud 261. Forward end mandrel 264 has a cylindrical shape with a first diameter 266 extending for a predetermined distance and then tapering into the smaller second diameter 269, which in a preferred embodiment is equal to second diameter 268. Forward end mandrel 264 is further formed with a threaded bore 265 to threadably receive threaded stud 261.

After the carbon fiber has hardened and cured into arrow shaft 209, with the aid of releasing agents the tail end mandrel 260 and the forward end mandrel 264 is removed from the arrow shaft 202. Before removing the mandrels, the tail end mandrel 260 and the forward end mandrel 264 are decoupled from one another and pulled apart from the arrow shaft 202 in directions 263 and 267, respectively.

Figure 12:
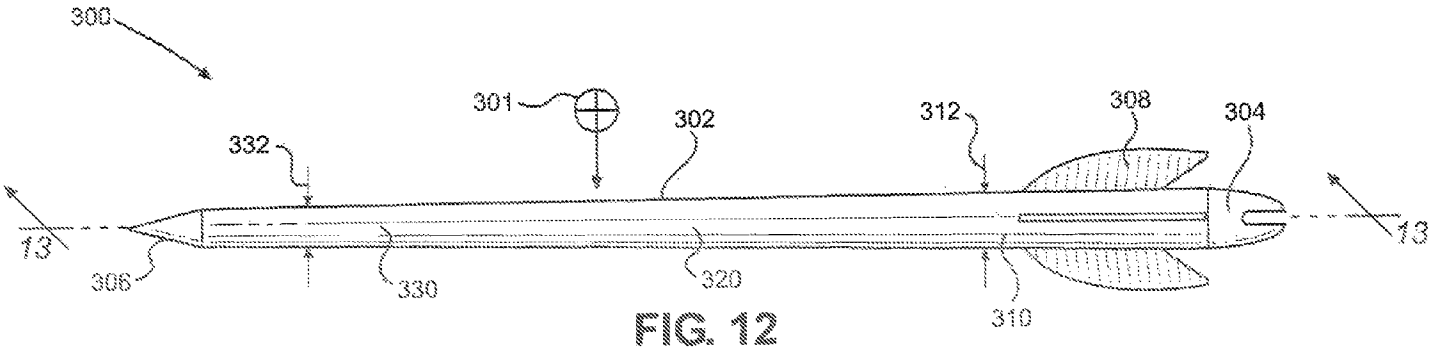
FIG. 12 is a side view of an alternative embodiment of the arrow of the present invention showing a tapered arrow shaft having a wider exterior diameter at the nock end and tapering to a smaller exterior diameter at the tip end.

Referring now to FIG. 12, a side view of an alternative embodiment of the arrow of the present invention is shown and generally designated 300. Arrow 300 has a shaft 302 with a tail section 310 having an exterior diameter 312, taper section 320, and forward section 330 having an exterior diameter 332 smaller than exterior diameter 332. The taper section 320 tapers from the tail section 310 to the forward section 330. Arrow 300 includes a tip 306 inserted into the arrow shaft 302 at the forward section 330, a nock 304 is inserted into the arrow shaft 302 at the tail section 310, and attached to the exterior of arrow shaft 202 on the tail section 310 adjacent to the nock 304 is fletching 308. Arrow 300 is shown having an exemplary center-of-gravity 301 which, as is known in the art, may be adjusted along the length of the shaft 302 by taking into account the center of gravity of the arrow shaft 302 and adjusting the weights of tip 306, fletching 308, and nock 304.

In an exemplary example, the exterior diameter 312 is approximately between 0.210 and 0.388 inches and the exterior diameter 332 is also approximately between 0.210 inches and 0.388, with the exterior diameter 332 of forward section 330 smaller than exterior diameter 312 of the tail section 310. As a result, the forward section 330 has less surface area and the taper section 320 provides a smooth transition from the smaller forward section 330 to the larger tail section 310, creating an aerodynamic arrow body with a small coefficient of drag resulting in less friction in the air and within a target when penetrating. The larger exterior diameter 312 of the tail section 310 of arrow shaft 302 is able to absorb and dampen the vibration caused by the impact from a bowstring when the arrow 300 is fired better than a smaller diameter arrow, resulting in a more controlled flight.

Figure 13:
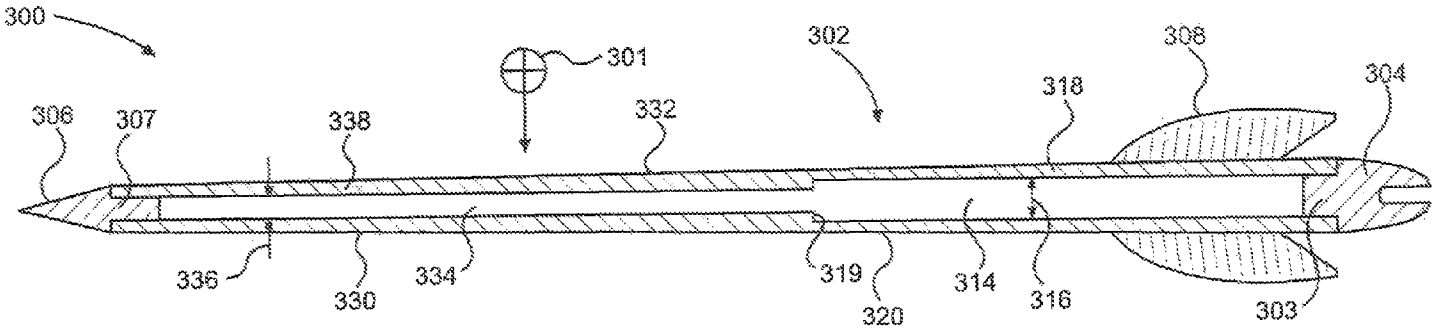
FIG. 13 is a cross-sectional view of the arrow of FIG. 12 showing the arrow shaft formed with a non-uniform exterior surface having multiple exterior diameters and a non-uniform axial bore having multiple diameters.

FIG. 13 is a cross-sectional view of the arrow 300 of the present invention taken along line 13-13 of FIG. 12, and showing the arrow shaft 302 having a non-uniform axial bore with multiple diameters having a forward section 338 and tail section 318. The arrow shaft 302 is formed with the non-uniform axial bore with a tail bore 314 and forward bore 334. Tail bore 314 has a diameter 316 sized to closely receive a standard nock 304. The outside diameter of insert 303 of nock 304 creates an interference fit with the tail bore 314 to provide a secure fit for nock 304 and may be further affixed with an adhesive or other methods know in the art. Tail bore 314 terminates at shoulder 319 and forward bore 334 begins at shoulder 319 and terminates at the tip of arrow shaft 302. The forward bore 334 has a diameter 336 which is smaller than diameter 316 of tail bore 214. The forward bore 334 is sized to closely receive an insert 307 of tip 306. As depicted, the arrow 300 has two internal bores however, it is to be appreciated that any number of bores with different diameters is contemplated without departing from the scope and spirit of the present invention.

As depicted, the arrow 300 is formed with the arrow shaft 302 having the tail section 310 with taper section 320 tapering to the forward section 330, resulting in a varying external diameter or multiple specific exterior diameters. Further, the arrow shaft 302 is formed with the tail bore 314 and forward bore 334, resulting in arrow 300 with multiple interior diameter such as 316 and 336. It is appreciated that the number of bores and external sections with different diameters could be varied without departing from the spirit and scope of the present invention.

As a result of the tail section 310, taper section 320, forward section 330, tail bore 314, and forward bore 334, the arrow shaft 302 has multiple wall thicknesses. Due to the varying thicknesses of the arrow shaft 302 walls, the weight distribution of the arrow shaft is unequal. Due to the smaller forward bore 334 compared with the tail bore 314, more material and thus weight is located towards the front of the arrow shaft 302. By modifying the length of the tail section 310, taper section 320, and forward section 330 in conjunction with modifying the length and diameter of tail bore 314 and forward bore 334, the center of gravity 301 may be shifted along the length of the arrow shaft 302. After taking into account the center of gravity of the arrow shaft 302, the tip 306, fletching 308, and nock 304 is applied to adjust the center of gravity 301 of the arrow 300. As a result, a greater degree of adjustability and tuning of the center of gravity 301 of the arrow 300 may be achieved.

The construction of the arrow 300 having multiple interior diameters and multiple exterior diameters also affect the stiffness of the arrow 300. The stiffness of an arrow is determined by the material of the arrow, the interior and exterior diameters of the shaft, the thickness of the shaft wall, the interior and exterior wall geometry, and the length of the arrow shaft. Although the arrow shaft 302 has an overall stiffness, the stiffness of the arrow shaft 302 varies along the length due to the multiple diameters and wall thicknesses.

Figure 14:
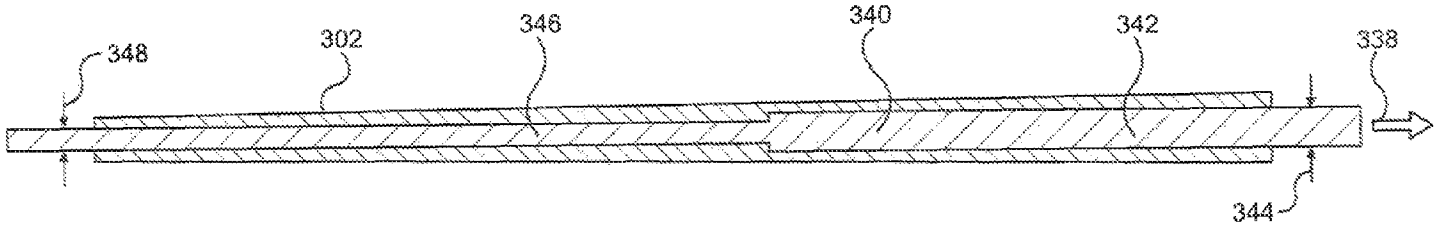
FIG. 14 is a cross-sectional view of the arrow of FIG. 12 showing the placement of a mandrel having two diameters positioned to form an arrow shaft having a first diameter at the nock end and a smaller second diameter at the tip end.

An example of a typical manufacturing method for arrow 300 is depicted in FIG. 14. Carbon fiber manufacturing is known in the art, and includes the wrapping of carbon fibers around a mandrel which is then heated and formed into the desired article of manufacture. Mandrel 340 used to manufacture arrow 300 and is similar to primary mandrel 230 as described above. Mandrel 340 is formed with a first cylindrical section 342 with a first diameter 344 forming a cylindrical section extending a predetermined distance and terminating into a second cylindrical section 346 having a second diameter 348 smaller than the first diameter 344.

After the carbon fiber has hardened and cured into arrow shaft 302, with the aid of releasing agents the mandrel 340 is removed from the arrow shaft 302 in direction 338. It is contemplated that the use of multiple cylindrical sections having different diameters forming mandrel 340 may be used to construct an alternative non-uniform axial bore within arrow shaft 302. It is further contemplated that the mandrel 340 may constructed of multiple pieces which may be combined to create axial bores having varying diameters, shapes, and sizes.

Figure 15:
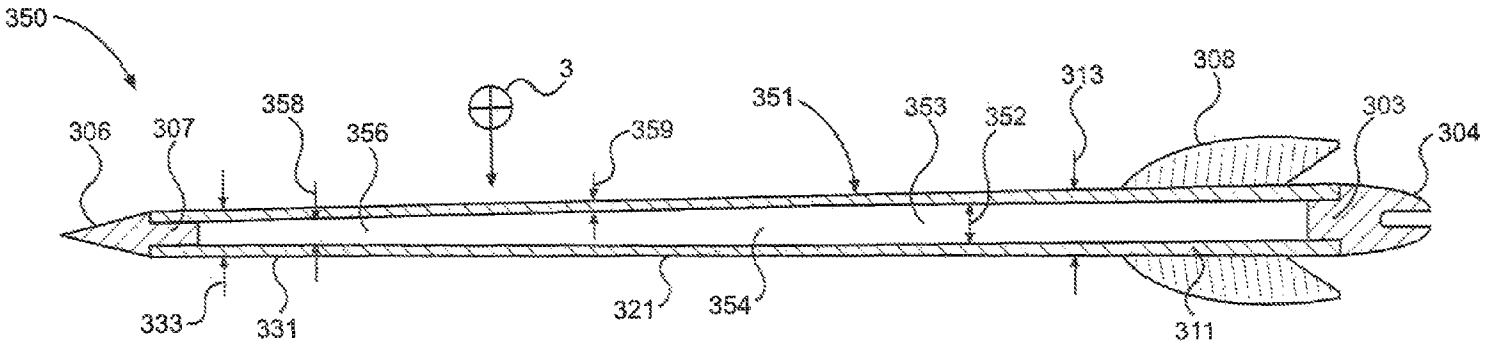
FIG. 15 is a cross-sectional view of the arrow of FIG. 12 showing an internal axial bore having a wider diameter at the nock end and tapering to a smaller internal diameter at the tip end.

Referring now to FIG. 15, a cross-section view of an alternative embodiment of the arrow of the present invention taken along lines 13-13 of FIG. 12 generally designated 350 with an alternative non-uniform axial bore is shown. Arrow 350 has a shaft 351 with a tail section 311 having an exterior diameter 313, taper section 321, and forward section 331 having an exterior diameter 333 smaller than exterior diameter 313. The taper section 321 tapers from the tail section 311 to the forward section 331. Arrow shaft 351 is formed with an alternative non-uniform axial bore having a tail bore 353 with diameter 352, a forward bore 356 having a diameter 358, and a taper bore 354 tapering from the tail bore 353 to the forward bore 356. The tail bore 353 is a cylindrical section having diameter 352 extending a predetermined distance and is formed to receive insert 303 of nock 304. Forward bore 356 is a cylindrical section having diameter 358 extending a predetermined distance and is formed to receive insert 307 of tip 306. Taper bore 354 tapers from diameter 352 to diameter 358, joining the tail bore 350 with forward bore 356. Arrow shaft 351 with the alternative non-uniform axial bore having tail bore 353, forward bore 356, and taper bore 354 has a uniform wall thickness 359 throughout the length. It is contemplated that various combinations of cylindrical bores and tapered bores may be used to form the axial bore of the arrow shaft 351 having multiple interior and exterior diameters without departing from the scope and spirit of the invention.

Figure 16:
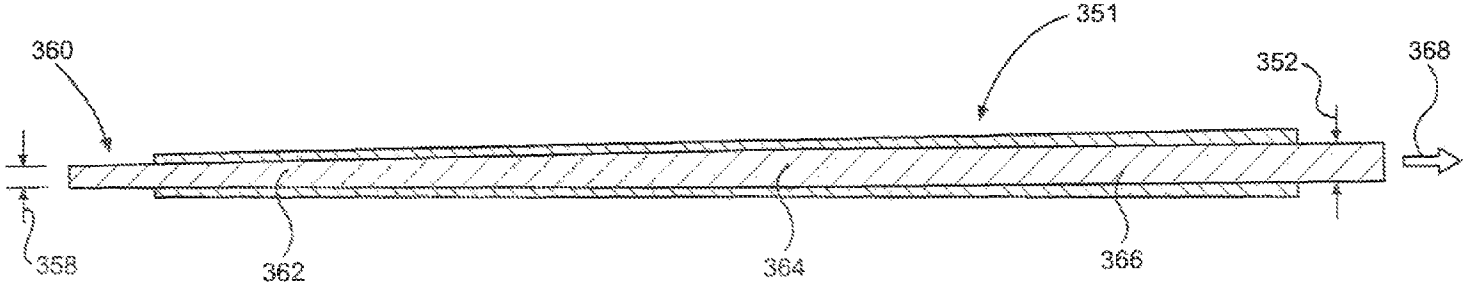
FIG. 16 is a cross-sectional view of the arrow of FIG. 15 showing the placement of a mandrel having a first diameter, a taper, and a second diameter positioned to form an arrow shaft having a first diameter at nock end tapering into a smaller second diameter at the tip end.

An example of a typical manufacturing method for arrow 350 is depicted in FIG. 16. For the present invention, a cross-section view of the arrow 350 shows the use of a mandrel 360 having three sections: forward section 362 having diameter 358, tail section 366 having diameter 352, and taper section 364 tapering from the tail section 366 to the forward section 362. Carbon fibers are wrapped around the mandrel which is then heated and formed into the desired article of manufacture. After the carbon fiber has hardened and cured into arrow shaft 351, with the aid of releasing agents the mandrel 360 is removed from the arrow shaft 351 in direction 368. It is contemplated that the use of multiple cylindrical sections having different diameters and multiple tapered sections forming mandrel 360 may be used to construct an alternative non-uniform axial bore within arrow shaft 302. It is further contemplated that the mandrel 360 may constructed of multiple components which may be combined to create axial bores having varying diameters, shapes, and sizes.

Although the present invention has been described herein with respect to preferred and alternative embodiments thereof, the forgoing descriptions are intended to be illustrative, and not restrictive. Those skilled in the art will realize that many modifications of the preferred and alternative embodiments could be made which would be operable, such as combining the various aspects of each preferred and alternative embodiments. All such modifications which are within the scope of the claims are intended to be within the scope and spirit of the present invention.

We claim:

1. An arrow comprising:

a cylindrical arrow shaft having a uniform external surface with a tip end and a nock end, and formed with a non-uniform axial bore having a forward bore with a forward bore diameter and a tail bore with a tail bore diameter, said cylindrical arrow shaft having a first wall thickness adjacent said forward bore and a second wall thickness adjacent said tail bore, wherein said first wall thickness is different than said second wall thickness;

a tip attachable to said tip end of said arrow shaft;

a fletching attachable to said exterior surface of said arrow shaft adjacent said nock end; and a nock attachable to said nock end of said arrow shaft.

2. The arrow of claim 1, wherein said forward bore diameter is smaller than said tail bore diameter.

3. The arrow of claim 1, wherein said non-uniform axial bare further comprises a tip bore having a tip bore diameter, said cylindrical arrow shaft having a third wall thickness, different from said first wall thickness, adjacent said tip bore.

4. The arrow of claim 3, wherein said tip bore diameter is equal to said tail bore diameter.

5. The arrow of claim 1, wherein said non-uniform axial bore further comprises:

a taper bore tapering form said tail bore to said forward bore.

6. An arrow having multiple exterior diameters and multiple interior diameters comprising:

a cylindrical arrow shaft having a non-uniform exterior surface with a tip and a nock end and formed with a non-uniform axial bore, said non-uniform exterior surface comprising a first exterior diameter adjacent said tip end and extending a predetermined distance of said arrow shaft, a second exterior diameter larger than said first exterior diameter adjacent said nock end and extending a predetermined distance of said arrow shaft, and a taper connecting said first exterior diameter with said second exterior diameter, said taper extending a predetermined distance of said arrow shaft;

a tip attachable to said tip end of said arrow shaft;

a fletching attachable to said exterior surface of said arrow shaft adjacent said nock end; and a nock attachable to said nock end of said arrow shaft.

7. The arrow of claim 6, wherein said non-uniform axial bore comprises:

a forward bore having a forward bore diameter; and a tail bore having a tail bore diameter.

8. The arrow of claim 7, wherein said forward bore diameter is smaller than said tail bore diameter.

9. The arrow of claim 7, wherein said non-uniform axial bore further comprises a tip bore having a tip bore diameter.

10. The arrow of claim 9, wherein said tip bore diameter is equal to said tail bore diameter.

11. The arrow of claim 6, wherein said non-uniform axial bore comprises:

a tail bore having a tail bore diameter;

a forward bore having a forward bore diameter, said forward bore diameter smaller than said tail bore diameter; and a taper bore tapering form said tail bore to said forward bore.

* * * * *

UNITED STATES PATENT AND TRADEMARK OFFICE

CERTIFICATE OF CORRECTION

PATENT NO. : 9,297,620 B2
APPLICATION NO. : 14/486587
DATED : March 29, 2016
INVENTOR(S) : Tod Boretto and Martin Connolly It is certified that error appears in the above-identified patent and that said Letters Patent is hereby corrected as shown below:

Claims

Column 12, line 19, claim 6, change "tip" to -tip end-

Signed and Sealed this
Nineteenth Day of July, 2016

Michelle K. Lee

Michelle K. Lee
*Director of the United States Patent and Trademark Office*